US005482755A

United States Patent [19]

Manning

[11] Patent Number: 5,482,755

[45] Date of Patent: Jan. 9, 1996

[54] READILY ATTACHABLE AND DETACHABLE COVERINGS FOR SURFACES

[76] Inventor: James H. Manning, 43 Butte des Mort Ct., Appleton, Wis. 54914

[21] Appl. No.: 234,122

[22] Filed: Apr. 28, 1994

[51] Int. Cl.[6] ..... B32B 3/02; B32B 3/06

[52] U.S. Cl. ..... 428/95; 428/100; 428/101; 428/304.4; 428/319.3

[58] Field of Search ..... 428/95, 101, 304.4, 428/319.3, 100

[56] References Cited

U.S. PATENT DOCUMENTS

| | | | |
|---|---|---|---|
| 2,717,437 | 9/1955 | Mestral | 28/72 |
| 3,042,446 | 7/1962 | Stahl | 296/137 A |
| 4,216,257 | 8/1980 | Schams et al. | 428/93 |
| 4,454,183 | 6/1984 | Wollman et al. | 428/92 |
| 4,761,318 | 8/1988 | Ott et al. | 428/95 X |
| 4,770,917 | 9/1988 | Tochacek et al. | 428/95 |
| 4,931,343 | 6/1990 | Becker et al. | 428/95 |
| 5,180,534 | 1/1993 | Thomas et al. | 264/145 |

FOREIGN PATENT DOCUMENTS

93/03889 3/1993 WIPO .

*Primary Examiner*—George F. Lesmes
*Assistant Examiner*—Blaine R. Copenheaver
*Attorney, Agent, or Firm*—Russell L. Johnson

[57] ABSTRACT

A readily attached and detached covering for large surface areas. To use the wall covering, the hook members of a hook and loop fastener system are attached to the surface to be covered. One side of the covering material is such that it can serve as a loop member for the hook member. The covering material can be secured in place and removed repeatedly without the need of special tools or precautions. The cover material is a composite having a hook member engaging layer on one side, a resilient layer and a dimensionally stable layer so that the material in place over a surface is dimensionally stable in the plane of the surface and resiliently accommodating in the direction perpendicular to the surface.

7 Claims, 2 Drawing Sheets

READILY ATTACHABLE AND DETACHABLE COVERINGS FOR SURFACES

FIELD

This invention relates to readily attachable and detachable coverings for large surfaces.

BACKGROUND

When it is desired to cover a large surface such as walls, floors, and the like , the art provides; substantially permanently attached coverings such as paint, wallpaper, paneling, linoleum (TM), inlaid carpets, tiles, and the like or removable coverings such as drapes, rugs, mats and the like. Heretofore, the art has not provided a durable readily attachable and detachable covering which is suitable for attachment to large surfaces.

OBJECTS

It is therefore an object of this invention to provide a readily attachable and detachable surface covering for large surfaces that gives properties to the surfaces that are not readily achieved by prior art surface coverings.

It is further an object of this invention to provide a method for installation and removal of the surface coverings described above.

It is further an object of this invention to provide the surface coverings and installation methods described above wherein a limited number of readily available tools are required to install and remove the surface covering.

It is further an object of this invention to provide the surface coverings and installation methods described above wherein no liquids or chemicals are used and there is little or no threat to the health and safety of the installers of the wall coverings or to the environment into which they are introduced.

It is further an object of this invention to provide the surface coverings and installation methods described above wherein the surface coverings may be given many different functional and aesthetic properties.

It is further an object of this invention to provide the surface coverings described above wherein local attachment members are secured to the surface to be covered and wherein a surface of the covering serves as a field attachment member.

Other objects will become apparent from the following specifications, drawings, and claims.

PRIOR ART

Hook and loop fasteners are old in the art. They are typically formed of two members. A hook member which is configured to penetrate and ensnare elements of a loop member.

U.S. Pat. No. 4,454,183 to Wollman; U.S Pat. No. 4,216,257 to Schams et. al.; and U.S. Pat. No. 5,180,534 to Thomas et al, are all examples of patents that teach, in part, improved hook members that are contemporary inventions which build upon the hook members taught in an earlier U.S. Pat. No. 2,717,437 patent to Mestral.

The loop member is typically a stranded member which will readily engage with the hooks of the hook member. U.S Pat. No. 3,708,833 teaches reticulated urethane foam as an alternative to engaging elements in loop form.

Published, International Application Number PCT/US92/06079, Applicant; Minnesota Mining and Manufacturing Company, teaches a covering material having abrasive grains adhered to a front surface of a backing and a multiplicity of loops projecting from a back surface of the backing and the loops are adapted to be releasably held on hooks along a support surface.

The prior art teaches that there is a plethora of hook and loop combinations available in the art and that novel and unobvious hook and loop elements are still being patented.

The prior art teaches the use of hook and loop type fasteners in conjunction with surface coverings.

The prior art also teaches the use of reticulated foams as one component of a hook and loop type fastening system.

This invention goes beyond the prior art in that it provides a novel and unobvious method of engagement of a hook and loop type securement means for a large surface covering which is suitable for use on surfaces in many spatial attitudes.

The invention employs hook members as local attachments secured to the surface to be covered. The local attachments act in cooperation with a laminated surface covering material which has a first side which faces the surface to be covered and which is in the form of a loop material which forms an attachment field for the hook members and a resilient sponge material bonded to the hook material to form a central layer, and a dimensionally stable outer layer bonded to the sponge layer to form a second side of the surface covering. The detachable three layer fabric is capable of covering large surfaces and is capable of imparting to a surface, properties that were not heretofore readily achievable in large surface coverings.

In assembly on a surface the foam element and the loop element of the surface covering of this invention resiliently accommodates to the shape of the hook members so that the presence of the hook members under the covering is not readily perceptible. A smooth outer surface which is not prone to drape or blouse is thereby achieved by the stable surface covering of this invention even though the surface to be covered is irregular.

BRIEF DESCRIPTION

The invention in one of its simplest forms is a detachable large surface covering having; a multiplicity of hook members secured to locations on a surface to be covered so as to frame the perimeter of the three layer fabric, the hook member serving as a local attachment means and a flexible three layer laminated covering material comprising; 1) a hook engaging loop layer attached to, 2) a resilient foam layer, which is attached to, 3) an outside, dimensionally stable layer. Said hook engaging loop layer serving as a field attachment means for said hook member, and when the covering material is drawn taught and the loop layer is engaged with a multiplicity of local attachment means secured to the surface to be covered, so that cover material lies evenly over the surface to be covered, the cover material is dimensionally stable in directions parallel to the surface being covered and is resiliently accommodating in the direction perpendicular to the surface being covered and the covering material thereby accommodates to irregularities in the surface being covered so as to provide a smooth outer surface.

DETAILED DESCRIPTION

Figure 1:
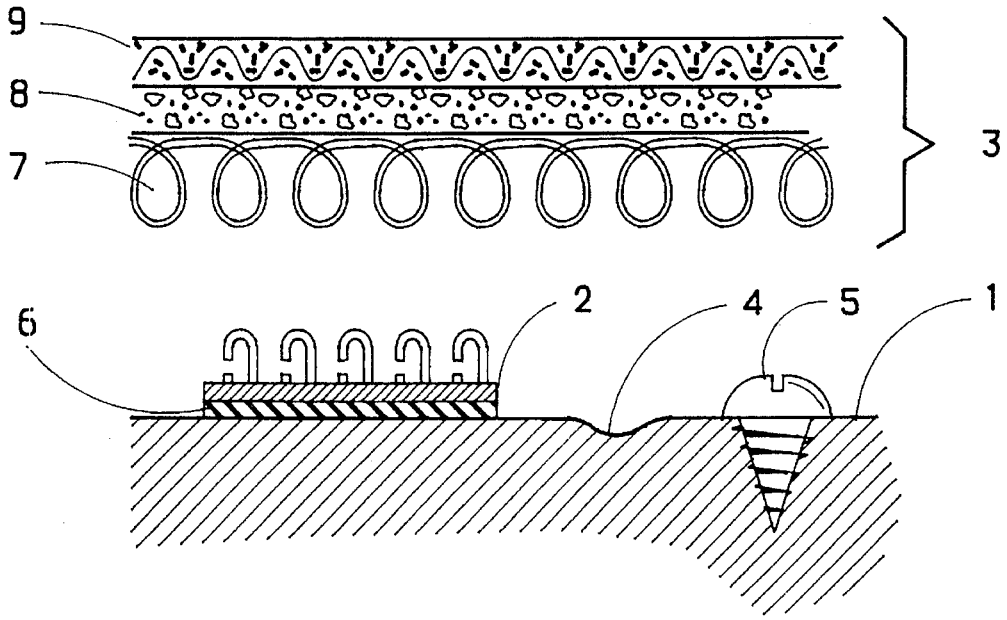
FIG. 1 is an elevational, cross sectioned, partially schematic view of the members of this invention separated from each other.

In the drawings like numbers refer to like objects and the dimensions of some elements have been modified to facilitate illustration.

In the following descriptions, the invention will first be discussed in the form of wall covering embodiments. It should be understood that the invention has diverse applications some of which will be discussed below.

The term "field of attachment" as used herein shall be understood to mean "a surface that has properties such that a local attachment means can be attached to the surface at any location on the surface".

The term "local attachment" as used herein shall be read to mean "a means by which securement can be had at a location on a field of attachment".

Figure 2:
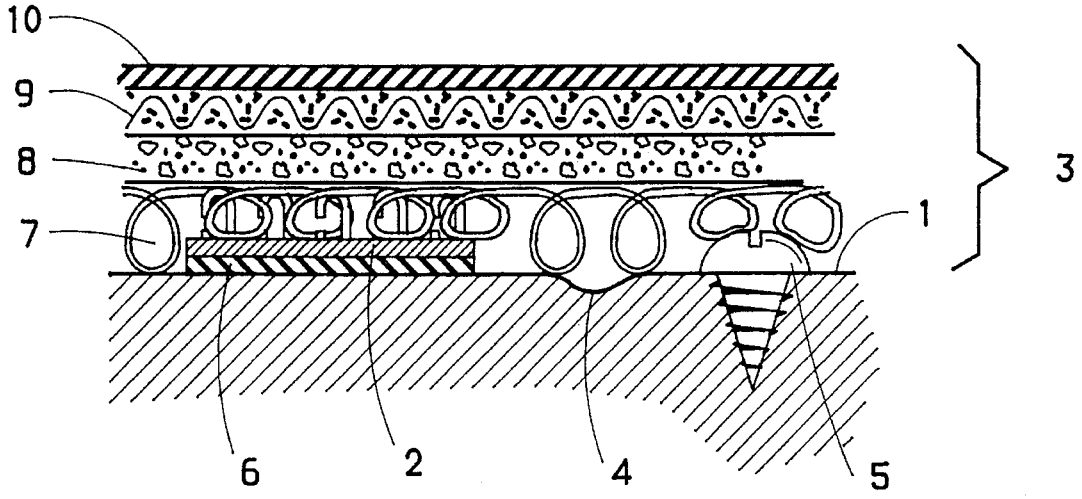
FIG. 2 is an elevational, cross sectioned, partially schematic view of the members of FIG. 1 joined with each other.
Figure 3:
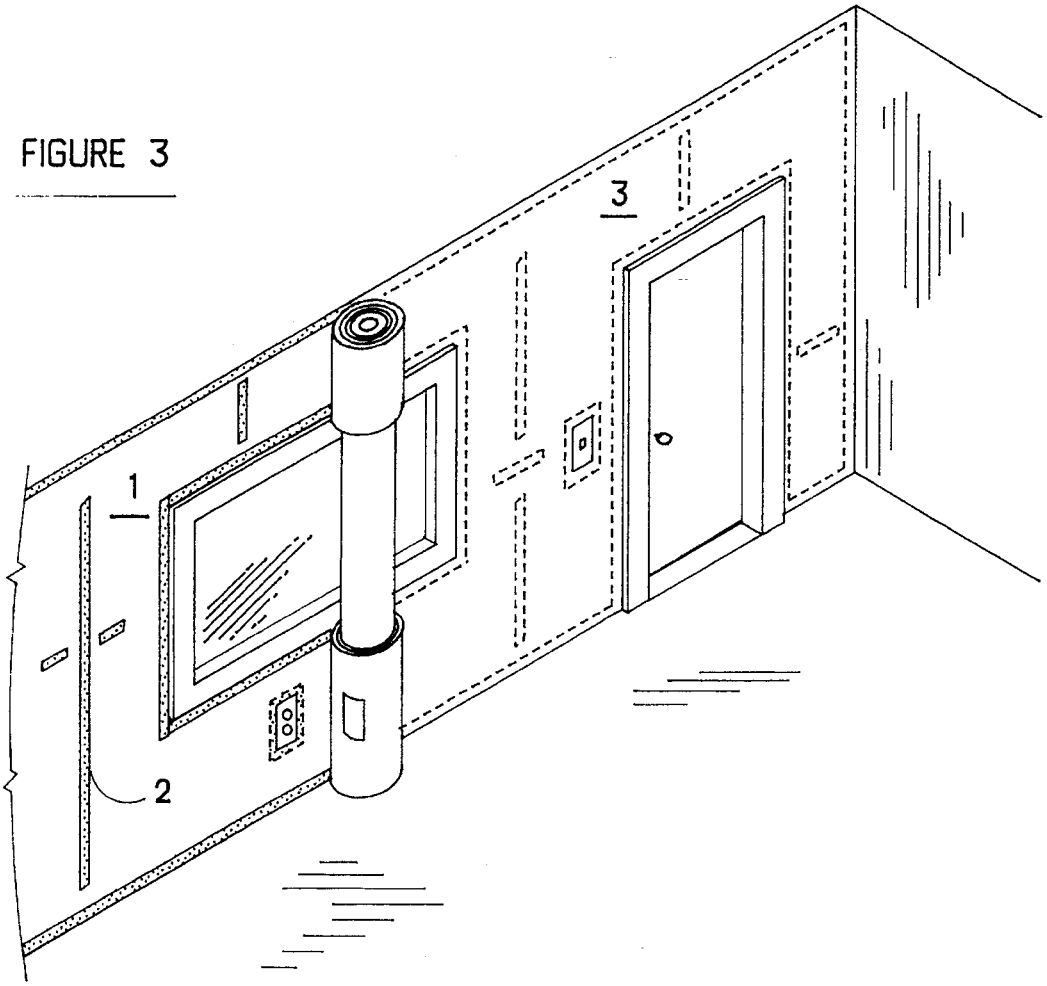
FIG. 3 is a pictorial view showing the cover material of this invention being secured to a surface to be covered.

Referring now to FIGS. 1 through 3 wherein the invention is shown in one of its simplest forms. A surface to be covered 1 has local attachments 2 secured thereto, and cover material 3 secured to attachments 2.

Referring now to FIGS. 1 and 2 wherein the members of the surface covering of this invention are shown schematically in cross section.

Surface to be covered 1 may be any large surface in need of covering either to change its appearance or to change its properties. Surface to be covered 1 may be, for instance, an unfinished structural surface having depressions such as grove 4, or projections such as fastener head 5, or a generally uneven and rough surface such as is commonly found in masonry walls and floors.

Local attachment 2 is typically a hook member such as a pressure sensitive adhesive tape which has hooks on its outer surface. One such tape is; Tape 88; provided by Velcro, Inc. of Manchester, N.H. Another such tape is; Aplix (TM) 800, 2" HK WHT PS; provided by Aplix, Inc., of South Holland Ill. Local attachment 2 may be secured to surface to be covered 1 by adhesive means 6, as shown, or by hot melt adhesive, or by conventional mechanical fasteners such as nails, screws, or staples. Local attachments 2 are substantially permanently secured to surface to be covered 1 at strategic locations around the perimeter of surface to be covered 1. Local attachments 2 are also typically secured on or near features such as doors and outlets which are a part of surface to be covered 1 and on large uninterrupted spans of surface to be covered 1, so as to engage the edges of cover material 3.

Cover material 3, in its simplest form has three layers; wall side layer 7, a foam layer 8, and a dimensionally stable layer 9. Cover material 3 may be a single built-up structure such as the textured acoustical wall fabric sold under the name, Silence, by the J. M. Lynne Co. Inc. of Smithtown N.Y.

Wall side layer 7 is formed of material that can serve as a loop member of a hook and loop fastener combination wherein the hook members are local attachments 2. Layer 7 may be of any suitable material. One such material has been found to be; velour knit fabric 573, provided by Vanity Fair, Monroeville, Ala. Another such material has been found to be; stitch bonded fabric, T878; provided by Tierex Fabrics, of Spartanburg, S.C. A material suitable as wall side layer 7 has a thickness which is approximately equal to the height of the loops of local attachment 2.

Dimensionally stable layer 9 may be any suitable material that is flexible and can serve to provide dimensional stability in the plane of cover material 3. That is, the material has very low creep and low hydroexpansivity. Several Tietex 100% polyester stitch-bonded non wovens, provided by Tietex Fabrics of Spartansburg Ala., have shown themselves to be a satisfactory material for providing a dimensionally stable layer to the cover material of this invention. Other non-woven materials such as DuPont's Tyvek (™), 100% Polyethylene; International Paper's wet laid Stripfil (™) non wovens; and Reemay, Inc. 100% polyester spunbond non woven; are suitable materials of which to form dimensionally stable layer 9.

Wall side layer 7 and foam layer 8 may be joined to each other by adhesive or fusion bonding or by flame bonding or they may be provided as a single unit.

A dimensionally stable layer 9 is joined to foam layer 8 by any suitable means. Means such as; adhesive bonding, fusion bonding, or flame bonding are suitable for bonding a dimensionally stable layer 9 to a foam layer 8. Foam layer 8 is formed of a resilient foam. Such a foam is the urethane foam provided by, General Foam Corporation of Paramus, N.J., having a thickness in the order of 1.7 mm and a basis weight of 46 9 gm/m$^2$.

A dimensionally stable layer 9 may be secured to foam layer 8 of cover material 3 to provide cover material 3 with additional properties which have utilities in specific applications. Dimensionally stable layer 9 may provide a variety of useful properties to cover material 3. Dimensionally stable layer 9 may provide cover material 3 with an embossed outside surface, an attractive outside surface, an acoustical outside surface, a reflective outside surface, a decorative outside surface, an electrically conductive outside surface, as well as a readily cleaned or a soilage resistant outside surface. An additional utilitarian layer 10 may be joined to the dimensionally stable layer 9 to provide utilitarian attributes to cover material 3.

EXAMPLE 1

An example of the method of this invention is as follows. A poured concrete wall which was painted, was used for a test wall. Aplix (™) tape with pressure sensitive adhesive on one side and self gripping hook fasteners on the other side served as local attachments. A three layer surface covering material was secured to the test wall by positioning the covering material on the local attachments and applying moderate hand pressure around the perimeter of the covering material. The resulting covering gave the wall a flat appearance even though the poured concrete wall had both lumps and dimples. The local attachments did not show through the covering material. The covering material when attached to the wall showed adequate dimensional stability with no sagging or blousing being observed. The wall covering was sprayed heavily with water and air dried with no wrinkling being observed.

EXAMPLE 2

An example of a typical covering material made according to this invention is as follows. A three layer covering material was formed by bonding a loop layer to a first side of a foam layer and by bonding a dimensionally stable layer to a second side of the foam layer to form a trilaminate.

Loop layer;

material; 100% polyester velour loop construction basis wt.; 125 gm/m$^2$ caliper; 1.2 mm Center layer;

material; 100% polyurethane foam basis wt.; 46 gm/m$^2$ caliper; 1.7 mm

Stabilizing layer;

100% polyester tricot knit basis wt.; 45 gm/m$^2$ caliper; 0.26 mm

FIG. 3 illustrates a process for providing a covering for large surfaces using the readily attachable and detachable covering of this invention. The process comprises the steps of;

a) securing a multiplicity of local attachments 2 around the perimeter of a surface to be covered 1 and at strategic locations on the surface to be covered 1, b) preparing a sheet of cover material 3 to conform to the geometries of the surface to be covered 1, c) attaching the cover material 3 to the wall surface to be covered 1 by means of engaging the wall side layer 7 of cover material 3 with the local attachments 2 so as to detachably attach the cover material 3 to the surface to be covered 1.

A novel aspect of cover material of this invention when applied to a surface by the method described above is the synergistic effect provided by the layers of the cover material so as to present a smooth surface appearance to the applied surface covering.

Another novel aspect of the above described process is that the installation can be carried out without the need for special tools and or presenting hazards that require protection of the venue wherein the surface covering is being applied.

Another novel aspect of the above described process is that it permits the repositioning and realignment of cover material 3 so that cover material 3 can be adjusted to lie evenly along surface to be covered 1.

Referring again to FIG. 3, the synergistic effect of the three layers of cover material 3 are imperfectly understood, but when cover material 3 is applied to a wall surface such as surface 1, the covering resists draping and/or blousing which would be seen as a defect in a wall covering material.

In practice the readily attachable and detachable surface covering of this invention may serve in many roles. For example; an area of floor in a nursery school may be provided with local attachments 2 so that a floor covering having a padded outside layer 10 could serve for periods when the children are participating in exercises or are napping. At another time, the floor covering may be changed to an easily cleaned surface for use during lunch or when the children are working with materials that could spill such as paints and the like.

For another example; the walls of a restaurant or the lobby of a business establishment can be provided with detachable wall coverings that can be readily changed with the change in the seasons, or to fit in with special promotions.

An often desirable attribute of surface coverings made according to this invention is that they can be made machine washable so as to permit removal for convenient cleaning and reuse.

The above disclosures with regard to cover material 3 and the process for employing cover material 3 is enabling and would permit one skilled in the art to make and use the readily attachable and detachable surface covering of this invention without undue experimentation. However, the scope of this invention should not be limited to the examples disclosed, but rather the scope of this invention should only be limited by the scope of the appended claims and all equivalents thereto which would become apparent to one skilled in the art.

What is claimed is;

1. A readily attachable and detachable covering for large surface areas comprising:

A) a flexible laminated surface covering material; and

B) attachment means including a multiplicity of hook members, said hook members being substantially permanently securable to locations on a surface to be covered by said flexible laminated surface covering material, so as to serve as local attachment means for said flexible laminated surface covering material; said flexible laminated surface covering material comprising: 1) an outside loop layer, said loop layer being structured so as to serve as field attachment means for said hook members; 2) a resilient open cell foam layer joined to the loop layer at the surface opposite the surface securable to the hook members; and 3) a dimensionally stable non woven fabric layer joined to the foam layer at the surface opposite the surface joined to the loop layer; wherein the layers of said flexible laminated surface covering material cooperate with each other so that the flexible laminated surface covering material is drawn taught over the surface to be covered and the loop layer is engaged with the multiplicity of hook members so that the flexible laminated surface covering material lies evenly over the surface to be covered, the flexible laminated surface covering material being dimensionally stable in directions parallel to the surface being covered and being resiliently accommodating in a direction perpendicular to the surface being covered.

2. The covering of claim 1 wherein the loop layer has a caliper of at least 1.0 mm and at most 15.0 mm and a basis weight of at least 100 gm/m$^2$ and at most 300 gm/m$^2$.

3. The covering of claim 1 wherein the dimensionally stable layer has a caliper of at least 0.1 mm and at most 10 mm and a basis weight of at least 40 gm/m$^2$ and at most 200 gm/m$^2$.

4. The covering of claim 1 wherein the foam layer has a caliper of at least 1.0 mm and at most 15.0 mm and a basis weight of at least 35 gm/m$^2$ and at most 150 gm/m$^2$ and a specific gravity of at least 7.0 lb/ft$^3$ and at most 35 lb/ft$^3$.

5. The covering of claim 1 wherein the loop layer is a 100% polyester velour loop construction, having a basis weight in the order of 125 gm/m$^2$ and a caliper in the order of 1.5 mm; the foam layer is a 100% polyurethane foam having a basis weight in the order of 46 gm/m$^2$ and a caliper in the order of 1.7 mm and a specific gravity in the order of 28 lb/ft$^3$; and a dimensionally stable layer a 100% polyester tricot knit, having a basis weight in the order of 129 gm/m$^2$ and a caliper in the order of 0.26 mm.

6. The covering of claim 1 wherein a utilitarian layer is bonded to the dimensionally stable layer at the surface opposite the surface joined to the open cell foam layer to provide the covering with specific utilitarian attributes, said utilitarian layer is selected from the group consisting of an embossed outside surface, an acoustical outside surface, a reflective outside surface, a decorative outside surface, an electrically conductive outside surface, and a readily cleaned outside surface.

7. The covering of claim 1 wherein the said covering is attached to a surface to be covered by the steps of:

i) attaching to a large surface to be covered, a multiplicity of local attachments, said local attachments being in the form of said hook members, ii) positioning said covering material on said surface to be covered, and iii) securing said covering material to said local attachments by means of pressing said loop layer onto said local attachments to form hook and loop engagements.

* * * * *